US010340630B2

(12) United States Patent
D'Addario et al.

(10) Patent No.: US 10,340,630 B2
(45) Date of Patent: Jul. 2, 2019

(54) SOLDER-LESS, CRIMP-LESS, OVER-MOLDED SIGNAL CABLE

(71) Applicant: D'Addario & Company, Inc., Farmingdale, NY (US)

(72) Inventors: James D'Addario, Old Westbury, NY (US); Robert J. Cunningham, Levittown, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 55 days.

(21) Appl. No.: 15/185,220

(22) Filed: Jun. 17, 2016

(65) Prior Publication Data

US 2016/0372860 A1 Dec. 22, 2016

Related U.S. Application Data

(60) Provisional application No. 62/182,784, filed on Jun. 22, 2015.

(51) Int. Cl.

| | |
|---|---|
| ***H01R 13/58*** | (2006.01) |
| ***H01R 9/053*** | (2006.01) |
| ***H01R 4/50*** | (2006.01) |
| *H01R 4/26* | (2006.01) |
| *H01R 24/58* | (2011.01) |

(52) U.S. Cl.

CPC ..... *H01R 13/5845* (2013.01); *H01R 4/5033* (2013.01); *H01R 9/053* (2013.01); *H01R 13/5804* (2013.01); *H01R 4/26* (2013.01); *H01R 24/58* (2013.01)

(58) Field of Classification Search

CPC .. H01R 13/5845; H01R 13/5804; H01R 4/26; H01R 24/58; H01R 9/053; H01R 4/5033

USPC ..... 439/585, 393, 394, 427

See application file for complete search history.

(56) References Cited

U.S. PATENT DOCUMENTS

| | | | | | |
|---|---|---|---|---|---|
| 3,411,129 | A * | 11/1968 | Peters | H01R 4/5033 | 174/84 R |
| 3,744,007 | A * | 7/1973 | Horak | H01R 9/0521 | 174/75 C |
| 4,013,333 | A * | 3/1977 | Chang | H01R 4/5033 | 439/425 |
| 4,178,054 | A * | 12/1979 | Laudig | H01R 9/0518 | 439/394 |
| 4,261,632 | A * | 4/1981 | Narozny | H01R 24/40 | 439/393 |
| 4,739,126 | A * | 4/1988 | Gutter | H02G 3/065 | 174/655 |
| 5,066,248 | A * | 11/1991 | Gaver, Jr. | H01R 9/053 | 439/394 |
| 5,573,423 | A * | 11/1996 | Lin | H01R 4/5025 | 439/462 |

(Continued)

*Primary Examiner* — Travis S Chambers

(74) *Attorney, Agent, or Firm* — Alix, Yale & Ristas, LLP

(57) ABSTRACT

A signal cable comprising a plurality of plug parts forming a plug that is operatively connected to signal and ground conductors at one end of a coaxial cable, wherein the plug parts and the end of the coaxial cable are held together only by an insulating overmold material. The assembly has four operatively connected plug parts (12, 20, 24, 30); a signal conductor at one end (42) of a coaxial cable (40) conductively connected to one of the plug parts (12); and an overmold (54) encapsulating the end of the cable and a conductive connection between a cable ground sleeve and another plug part (30).

17 Claims, 10 Drawing Sheets

(56) References Cited

U.S. PATENT DOCUMENTS

| | | | | | |
|---|---|---|---|---|---|
| 5,607,320 | A * | 3/1997 | Wright | H01R 9/053 | 174/DIG. 13 |
| 5,913,694 | A * | 6/1999 | Wright | H01R 9/053 | 439/394 |
| 6,126,491 | A * | 10/2000 | McCarthy | H01R 4/5025 | 439/428 |
| 6,705,884 | B1 * | 3/2004 | McCarthy | H01R 4/5033 | 439/394 |
| 6,729,912 | B2 * | 5/2004 | D'Addario | H01R 13/17 | 439/675 |
| 7,121,872 | B1 * | 10/2006 | Hanks | H01R 4/5033 | 439/427 |

* cited by examiner

SOLDER-LESS, CRIMP-LESS, OVER-MOLDED SIGNAL CABLE

BACKGROUND

The present invention relates to solderless, high quality audio signal cables.

Audio signal cables have been used for many years for musical instrument amplification, sound reinforcement and high fidelity signal transmission. These cables are typically coaxial, with a central signal conductor surrounded by insulation, a ground conductor, and a covering. Because the cable length requirements of the end users can vary widely, cables are often sold without attached end connectors. The purchaser trims the ends of the cables to the desired a connector is attached at each end.

Attaching the connectors is typically tedious, requiring crimping or soldering, and subject to poor connectivity of the cable conductors to the respective contacts on the connectors.

SUMMARY

The present invention is directed to components and associated method of assembly, for producing a very high quality audio signal cable, suitable for musical instrument amplification, sound reinforcement and high fidelity signal transmission, without the need for crimping or soldering connections and pre-assembling the plug components.

From a general perspective, the invention is directed to a signal cable comprising a plurality of plug parts forming a plug that is operatively connected to signal and ground conductors at one end of a coaxial cable, wherein the plug parts and the end of the coaxial cable are held together only by an insulating overmold material.

In the disclosed embodiment, only four plug parts are necessary.

One plug part includes a cylindrical body having an axial bore in which the one end of the coaxial cable is situated, and at least one radial through hole. Overmold material surrounds the one part, fills the at least one hole, and intimately surrounds the one end of the cable. Also, a ground connector is pressed against a ground sheath in the coaxial cable and the pressing of the ground connector to the ground sheath is performed only by insulating overmold material.

The unique geometry of the components requires no more than four easily manufactured parts to be inserted into an automated or semi-automated mold with fixtures which in one step creates solid, permanent connections for the signal and ground terminations and then creates an injection molded plug body that securely holds all four plug components and the cable into place.

The advantages are the elimination of very costly soldering and/or crimpling labor steps in the process, enabling manufacture of the product in an automated manufacturing cell, thus significantly reducing cost while maintaining high-quality, extremely-durable connections. Because these cables are often used in harsh live, on-stage and/or studio conditions the cable assembly must be capable of sustaining its quality connections and tone without failure.

Conventional cables incorporate plug assemblies with additional parts to accommodate crimping or soldering and require pre-assembly which also adds additional cost to the final assembly. This process takes four relatively inexpensive plug components and a coaxial signal cable and in one step creates a professional quality audio signal cable.

BRIEF DESCRIPTION OF THE DRAWING

An embodiment of the invention will described below with reference to the accompanying drawing, in which.

DETAILED DESCRIPTION

Figure 1:
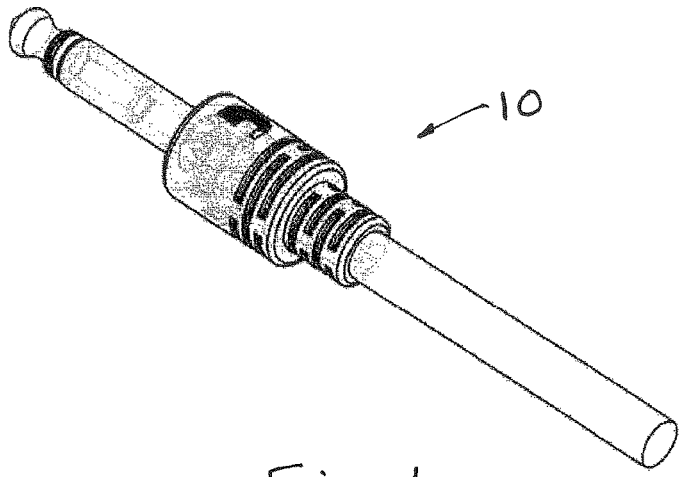
FIG. 1 shows a complete overmolded assembly consisting of four plug parts, a cable and an overmolded plug body.

FIG. 1 shows the completed overmolded assembly 10 consisting of four plug parts, the cable and an overmolded plug body. The plug tip and signal pin are one part. Conventionally, these are two parts that are pressed together. The ground tube and body together form a second part, the tip insulator is a third part and the ground connector strain relief ring is the fourth part. This ring is a stamped part that has tangs to engage the braided shield for the ground connection. In addition, the polymer overmold plug body and stripped coax cable are also shown. The modified 5C collet is part of the mold fixture and holds the plug parts tightly together and against the overmold to make a seal and prevent polymer from flashing around the ground tube and body part during assembly.

Figure 2:
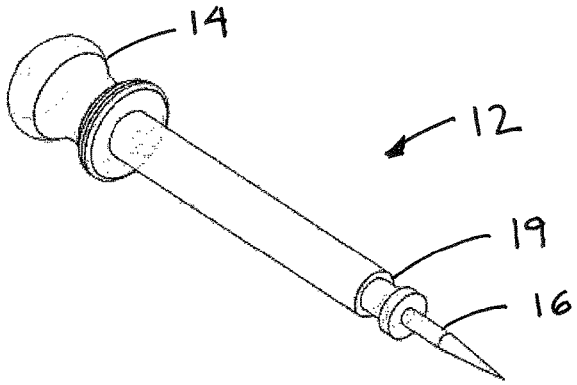
FIG. 2 shows the signal tip and pin as one part.

FIG. 2 shows how the signal tip 14 and pin 16 form a signal pin 12, which is one plug part. The pointed pin is forced into the center of the stranded coaxial signal cable, making a reliable connection that will be covered with injection molded plastic during the molding step. One or more grooves 19 are filled with polymer during the over-molding process. This holds the plug parts, cable and over-molded parts together after over-molding.

Figure 3A:
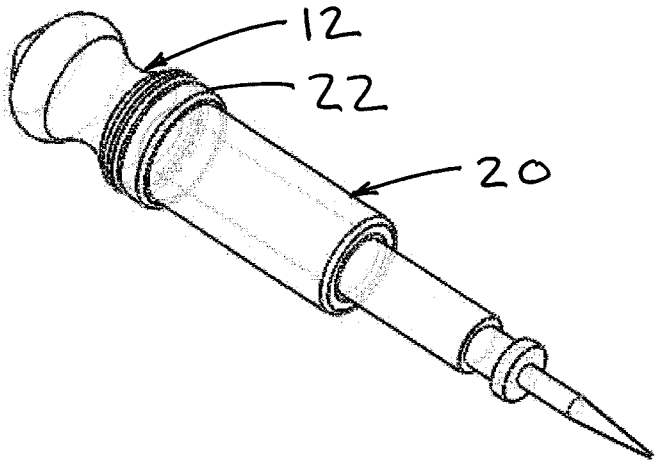
FIGS. 3*a* and *b* show a plastic signal tip insulator sleeve with front ring slid onto the signal tip and pin.

FIGS. 3*a* and *b* show how the plastic signal tip insulator sleeve 20 with front ring 22 is slid onto the signal tip and pin 12. This separates the signal component from the ground tube/body.

Figure 3B:
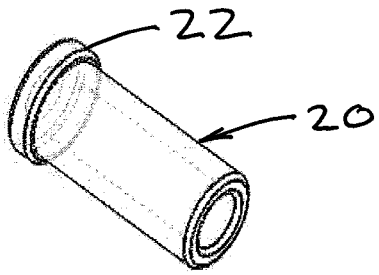
Figure 4A:
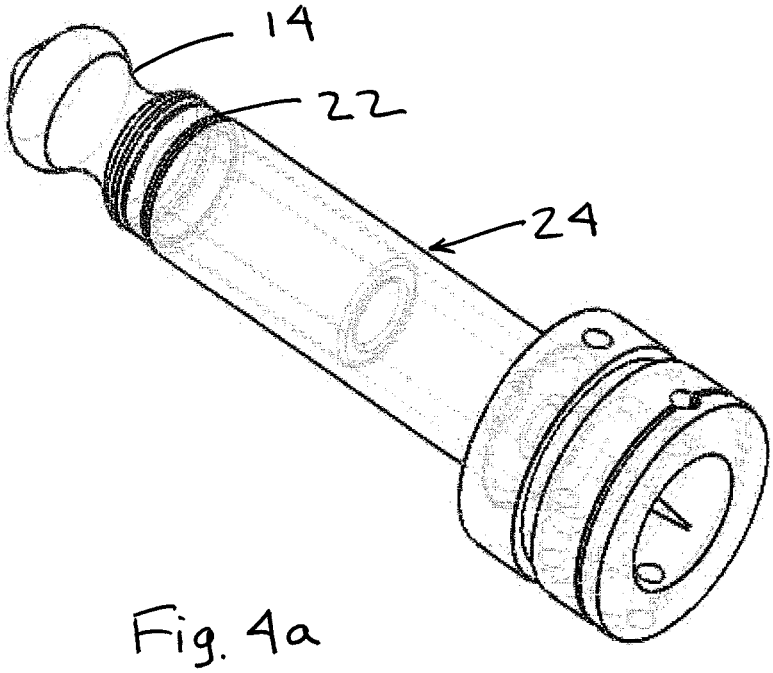
FIGS. 4*a* and *b* show ground element with tube and body 28 slid onto the sub-assembly shown in FIG. 3.
Figure 4B:
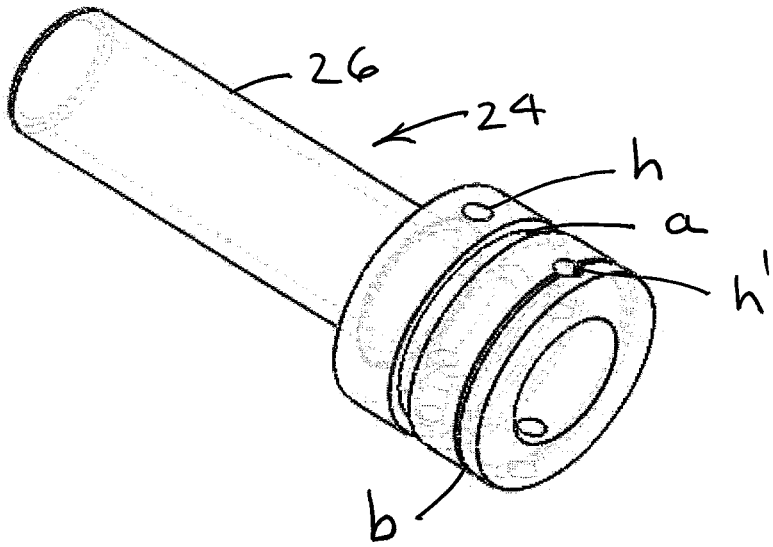

As shown in FIGS. 4*a* and *b*, ground element 24 with tube 26 and body 28 is slid onto the sub-assembly shown in FIG. 3. During over-molding, plastic flows into the one or more grooves or recesses a, b and through the port holes such as h, filling the body of the plug and holding the assembly together (i.e., at least pin 16 and free end of cable within bore 56). Two of the holes such as h' in the back groove b also locate the stamped ground connector and strain relief part.

Figure 5A:
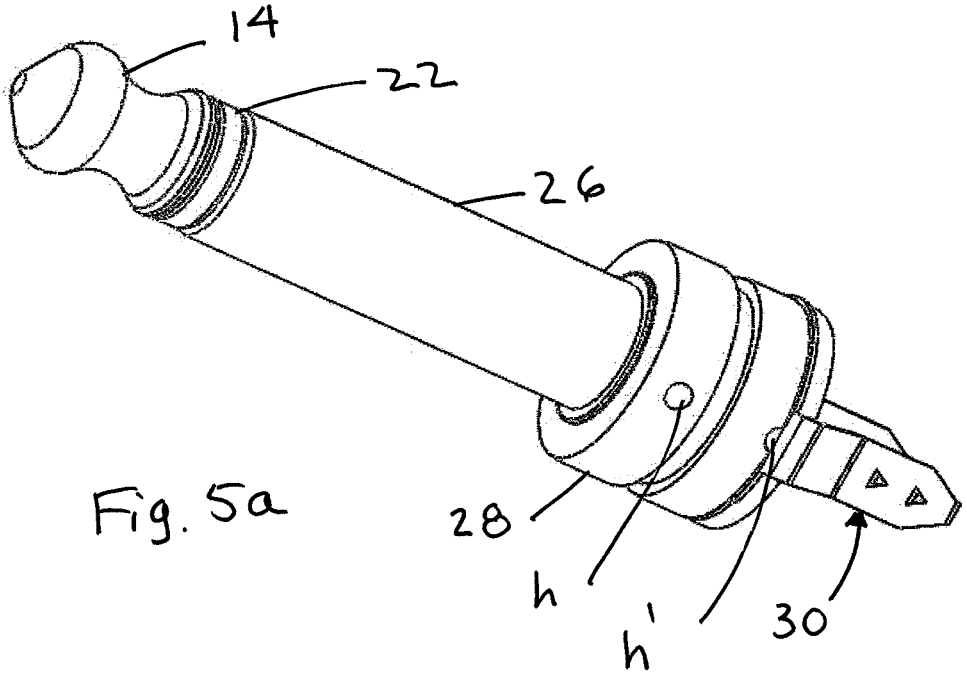
FIGS. 5*a* and *b* show details of the stamped metal ground connection and where it is attached to the plug body.
Figure 5B:
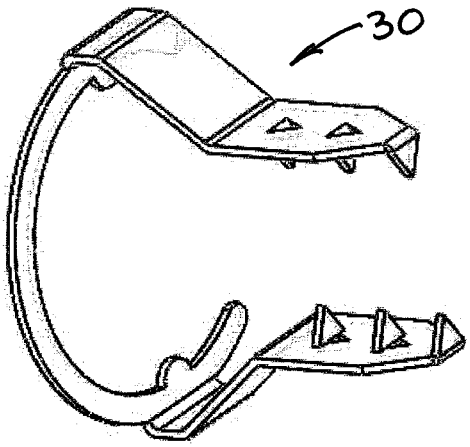
Figure 6A:
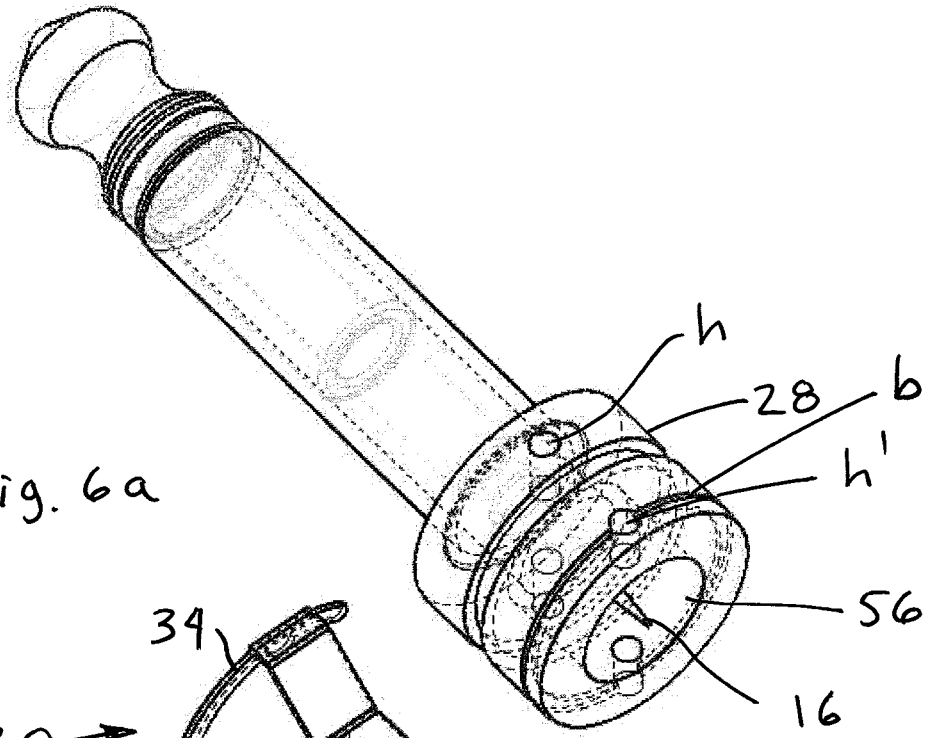
FIGS. 6*a* and *b* show how the stamped metal ground connection is slipped onto the ground sleeve/body.
Figure 6B:
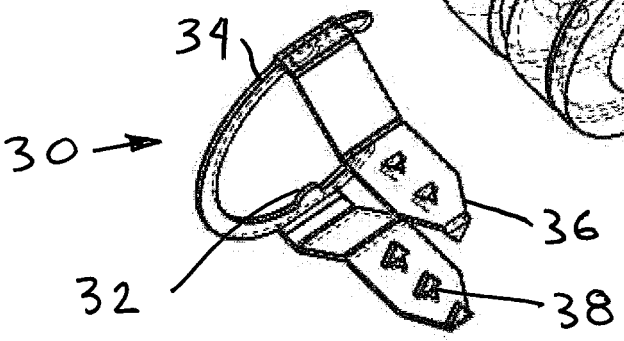

FIGS. 5*a* and *b* show details of the stamped metal ground connection 30 and where it attaches to the plug body. According to FIGS. 6*a* and *b* the stamped metal ground connection is slipped onto the ground sleeve/body into the back groove b. Two small protrusion features 32 on an arcuate portion 34 of the stamping engage with holes h' in the plug body to assure easy alignment and connectivity to the ground tube. This part has a pair of arms 36 with barbs or teeth 38 that during over-molding pierce the coaxial cable outer jacket, engaging the braided shield to make the ground connection. They also serve as secure strain relief. Features in the mold close on these two arms forcing them securely into the cable and ensuring positive strain relief.

Figure 7A:
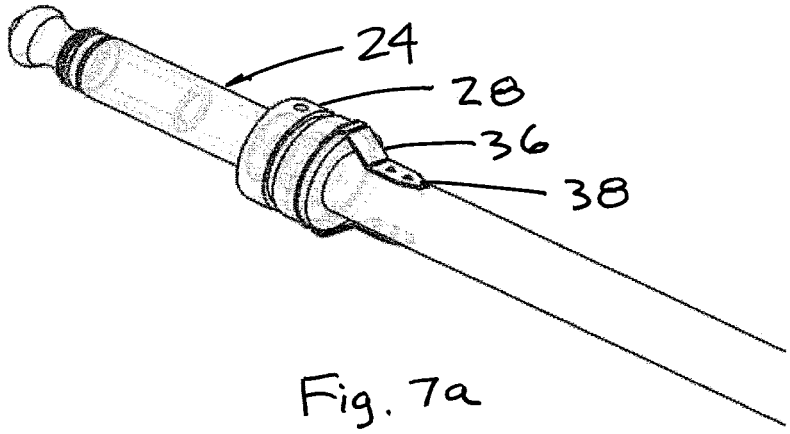
FIGS. 7*a* and *b* show the cable before and after insertion into the ground tube/body and on to the signal pin connection.
Figure 7B:
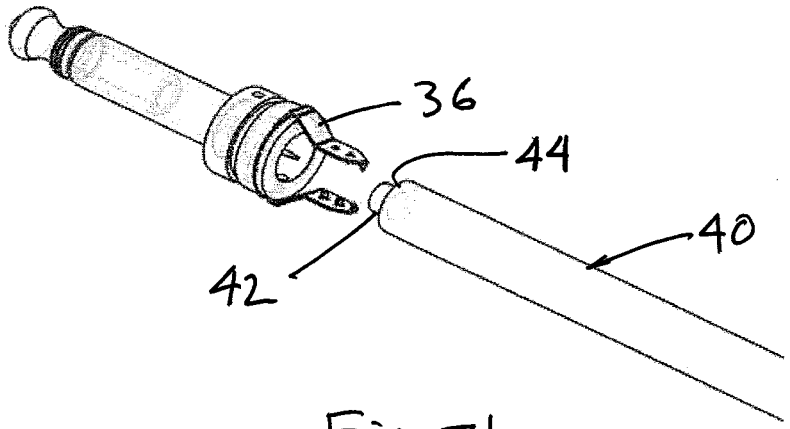

FIGS. 7*a* and *b* show the cable 40 before and after insertion into the ground element 24 (formed of the ground tube 26 and ground body 28) and on to the signal pin connection. The cable is partially stripped down to expose a forward end portion 42 of the cable, which is a still insulated signal wire. Only the outer cable jacket and the braided shield material 44 are stripped away. This is to step the cable back in the assembly to avoid the possibility that a strand of coax shield (ground) could accidentally contact the signal pin during assembly. The coax cable is automatically cut to length, stripped and tied by an outed machine process in the work cell. It is presented to the operator who will be assembling the plug parts into the mold, inserting the stripped cable and cycling the overmold process.

Figure 8:
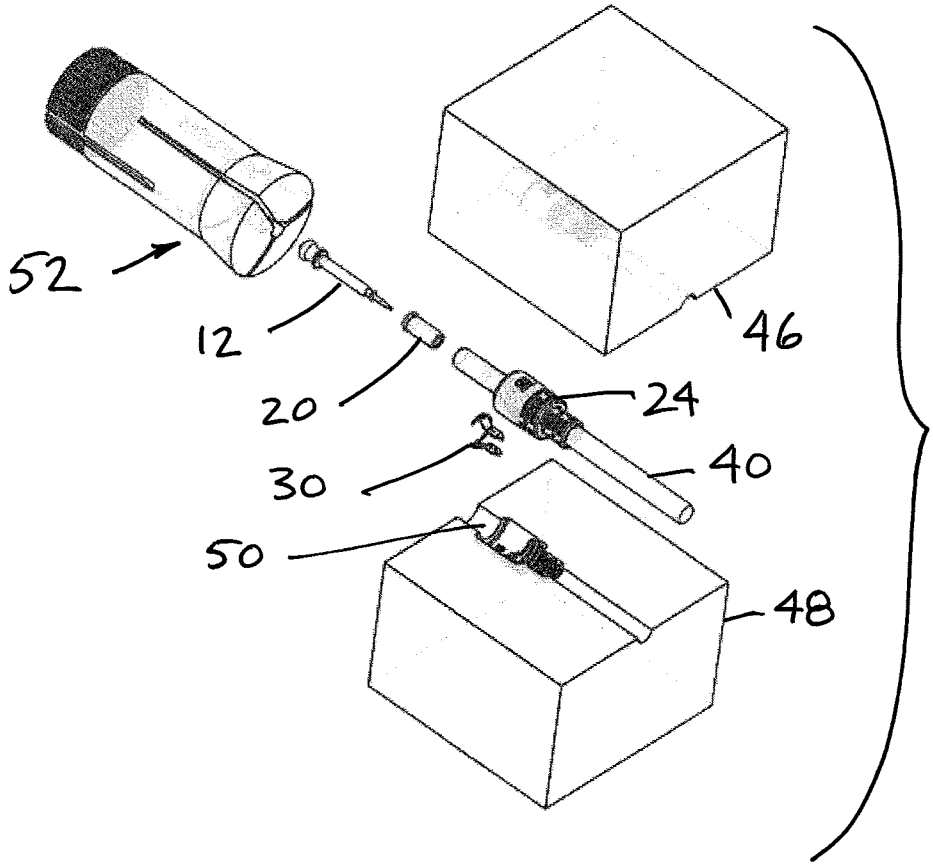
FIG. 8 is an exploded view of the assembly showing the upper and lower half of the mold that creates the over-molded plug body while locking all components together.

FIG. 8 is an exploded view of the assembly showing the upper 46 and lower 48 half of the mold that creates the over-molded plug body while locking all components together. The features 50 in the lower half of the mold force the connection tangs on the ground connector stamped part into the outer cable jacket and braided shield, thus making the ground connection. It also creates strain relief cuts in the overmolded part allowing the plug body to flex when in use. A collet fixture 52 is used to hold the plug parts securely together prior and during the over-molding process.

Figure 9:
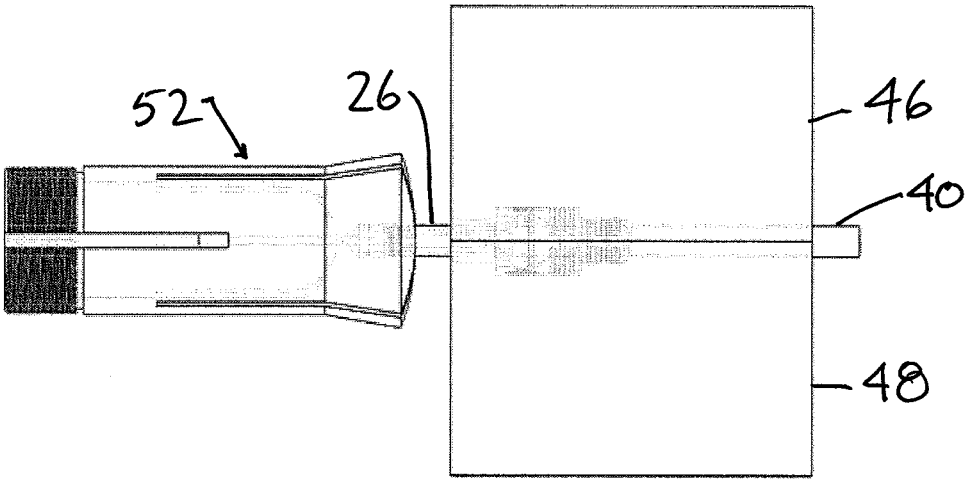
FIG. 9 is a side view of the assembly and the collet fixture, which holds the plug parts together during over-molding.
Figure 10:
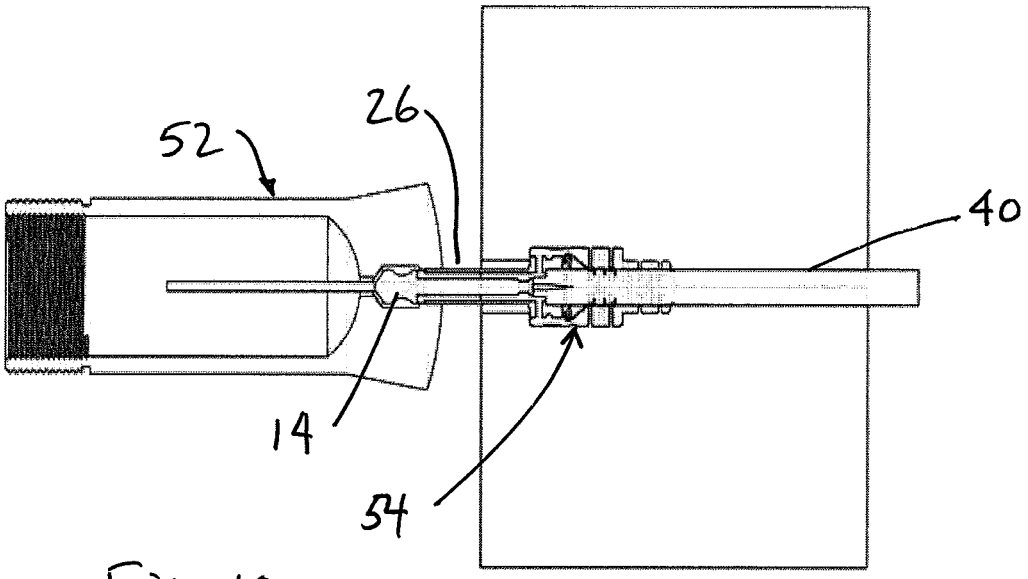
FIG. 10 is a cross section view of FIG. 9, with overmold.

FIG. 9 is a side view of the assembly and the collet fixture. The collet simply holds the plug parts together during over-molding. The upper and lower mold parts close on the plug parts and polymer is injection molded into the ground tube/body and around all the other internal components, forming the outer plastic plug body at the same time. FIG. 10 is a cross section view of FIG. 9, with overmold 54.

Figure 11:
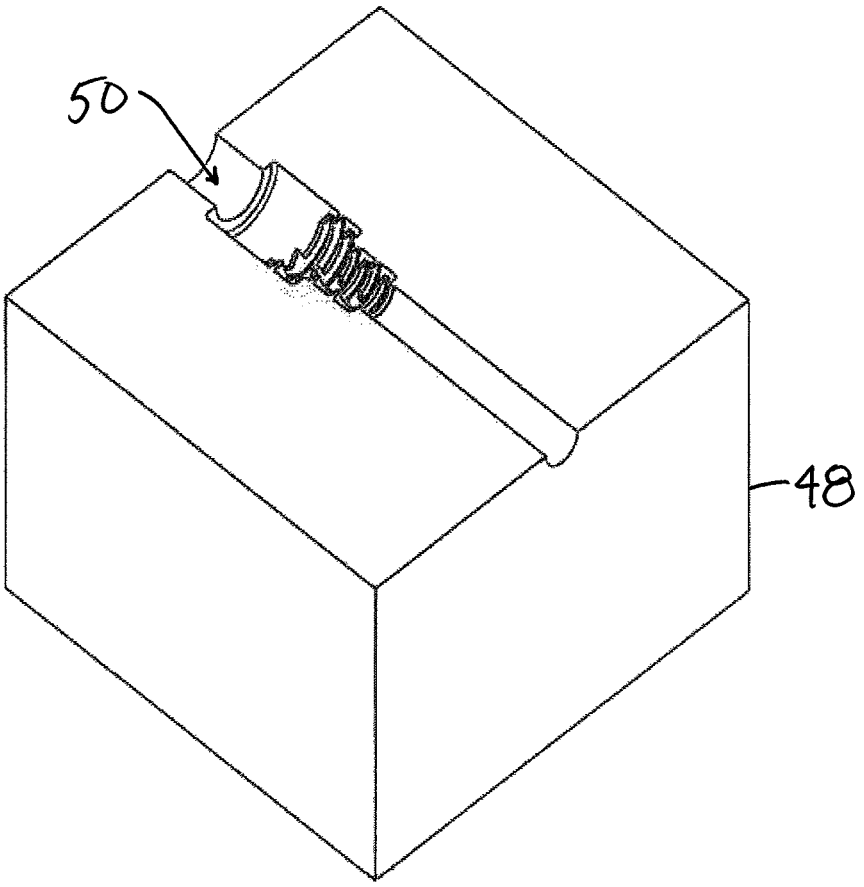
FIG. 11 shows the inside features of the lower half of the mold.

FIG. 11 shows the inside features of the lower half of the mold. The three larger circular protrusions force the tangs of the stamped ground connector into the braided shield to make the ground connection and create strain relief.

Figure 12:
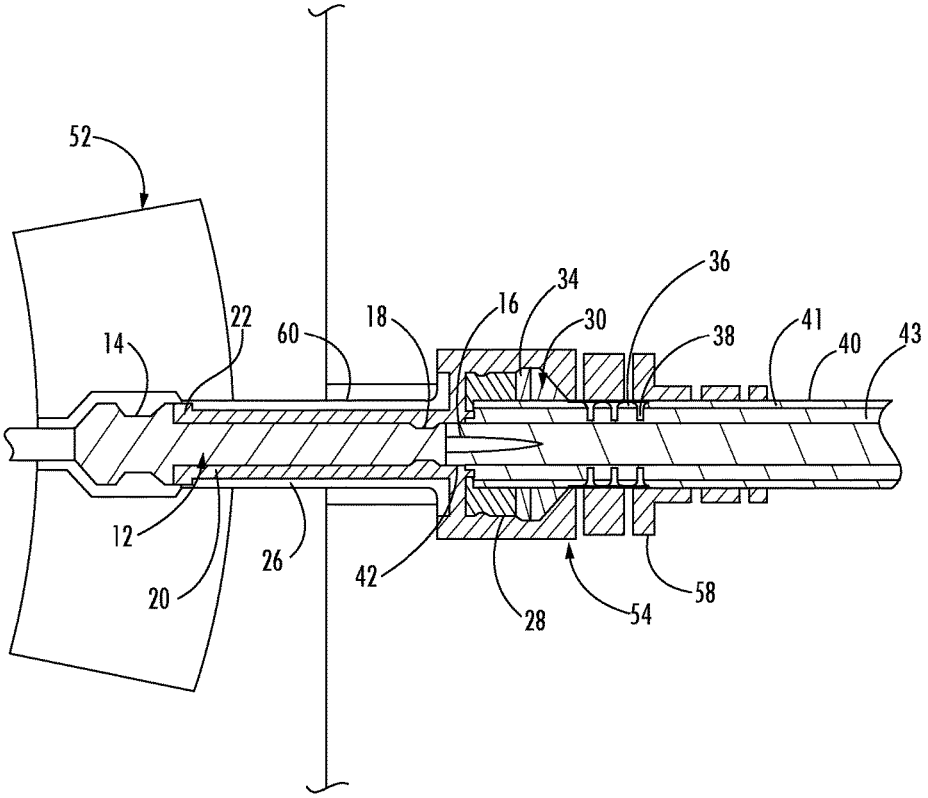
FIG. 12 shows details of the over molded region in FIG. 10.

FIG. 12 shows details of the over molded region in FIG. 10. The conductive signal back pin 16 with profile 18 is embedded in overmold material. The insulating sleeve 20 surrounds a forward portion of the pin 12 (which conducts a signal). The ground element 24 has a ground tube 26 around a portion of the insulating sleeve and a ground body 28 having a bore 56 for receiving the coaxial cable 40. The ground connector 30 is supported on the ground body 28 and extends rearward with the tangs 38 that have been forced through the cable jacket 41 into the ground sheath 43. The coaxial cable front end with central signal conductor engages the signal pin 16. The insulating overmold encapsulates the ground connector 30 and the ground body 28, the forward end 42 of the cable, and the profile 18. The overmold also forms a strain relief collar 58 that extends rearward of the ground connector 30. The overmold can also cover a back portion 60 of the ground tube.

It can thus be appreciated that the foregoing discloses a signal cable 10 comprising: four operatively connected plug parts (for example, a pin 12, sleeve 20, ground element 24, and ground connector 30); a signal conductor at the forward end portion 42 of a coaxial cable 40 conductively connected to one of the plug parts (for example, the pin 12); and an overmold 54 encapsulating the end of the cable and a conductive connection between a cable ground sleeve and another plug part.

The plug parts include (i) a conductive signal pin 12; (ii) an insulating sleeve 20 around a portion of the signal pin; (iii) a ground element 24 having a ground tube 26 around a portion of the insulating sleeve and a ground body 28 having a bore 56 for receiving the coaxial cable; and (iv) a ground connector 30 supported on the ground body and extending rearward with tangs 38. The coaxial cable 40 has a front end portion 42 with central signal conductor engaging the signal pin and the tangs engaging the cable ground conductor. The insulating overmold 54 encapsulates the ground connector 30 and the ground body 28.

A method of assembling a signal cable 10 is also disclosed. The steps include inserting a free end of the coaxial cable 40 into the bore of the ground body until the central signal conductor contacts the back pin 16, and placing the ground body 28 with inserted cable, in a mold. The mold is closed and a pressurized flow of insulating material is delivered through the mold through the ground body whereby a first portion of the insulating material flows into the bore around the cable and surrounds a portion of the signal pin 12 within the ground tube 26, and a second portion of the insulating material surrounds the ground body 28. The mold is opened and the signal cable 10 is removed, resulting in an over molded plug with the signal pin conductively engaging the central signal conductor and the ground conductor conductively engaging the ground sheathing.

The invention claimed is:

1. A signal cable assembly (10) comprising: four operatively connected plug parts, wherein the plug parts include a signal pin (12), a sleeve (20), a ground element (24) and a ground connector (30); a signal conductor at one end (42) of a coaxial cable (40) conductively connected to a first of the plug parts being the signal pin (12); and an overmold (54) encapsulating the end of the coaxial cable and a conductive connection between a ground sleeve of the coaxial cable and at least one second plug part different from the first plug part being selected from the group consisting of the sleeve (20), the ground element (24) and the ground connector (30), wherein a. the sleeve (20) is insulating and positioned around a portion of the signal pin; the ground element (24) has a ground tube (26) around a portion of the insulating sleeve and a ground body (28) has a bore (56) for receiving the coaxial cable; and the ground connector (30) is supported on the ground body and extends rearward with tangs (38);

b. the coaxial cable (40) has a front end with a central signal conductor (42) that engages the signal pin and the tangs engage a ground conductor of the coaxial cable; and c. the signal pin (12) has a front tip (14) and a back pin (16), and the insulating overmold (54) encapsulates the ground connector (30) and extends within the ground body, within the ground tube and around the back pin.

2. A signal cable assembly (10) comprising: four operatively connected plug parts, wherein the plug parts include a signal pin (12), a sleeve (20), a ground element (24) and a ground connector (30); a signal conductor at one end (42) of a coaxial cable (40) conductively connected to a first of the plug parts being the signal pin (12); and an overmold (54) encapsulating the end of the coaxial cable and a conductive connection between a ground sheath of the coaxial cable (43) and at least one second plug part different from the first plug part being selected from the group consisting of the sleeve (20), the ground element (24) and the ground connector (30), wherein a. the signal pin (12) is conductive with a front tip (14) and a back pin (16); the sleeve (20) is insulating and positioned around the signal pin between the front tip and the back pin; the ground element (24) has a ground tube (26) around a portion of the insulating sleeve and a ground body (28) having a bore (56) for receiving the coaxial cable; and the ground connector (30) is supported on the ground body;

b. the coaxial cable (40) has a front end with central signal conductor (42) that engages the back pin (16) and a ground connector (30) engages the cable ground sheath; and c. the overmold (54) is insulating and encapsulates the ground connector (30) and extends within the ground body (28), within the ground tube (26) and around the back pin (16).

3. A signal cable assembly comprising:

a. a conductive signal pin (12) extending along a longitudinal axis from a front signal tip (14) to a back pin (16);

b. an insulating sleeve (20) around the conductive signal pin, abutting the signal tip and terminating forward of the back pin;

c. a conductive ground element (24) including a ground tube (26) and a ground body (28), wherein the ground tube passes over the insulting sleeve, with a front spaced from the signal tip to a back that extends rearward of the back pin, and the ground body is an externally profiled (a, b) hollow cylinder that extends rearward from the ground tube such that a cable bore (56) is formed through the conductive ground element to the back pin;

d. a ground connector (30) supported on the ground body and having connector arms (36) that extend rearward with tangs (38) facing the longitudinal axis;

e. a coaxial cable (40) in said cable bore, having a front end (42) with central signal conductor engaging the back pin (16) and a cable portion (44) rearward of the ground body where the tangs of the connector (30) engage a cable ground sheath (43); and f. an insulating overmold (54) encapsulating the ground connector and the ground body.

4. The signal cable assembly of claim 3, wherein the ground connector (30) has internal mounting features (32) that engage external mounting features (h') on the ground body.

5. The signal cable assembly of claim 3, wherein the ground body (28) has a profiled exterior (a, b) and the insulating overmold intimately engages the profiles.

6. The signal cable assembly of claim 3, wherein the ground body has a plurality of external arcuate recesses (a, b) and through holes (h, h') to the cable bore; the ground connector has an arcuate portion (34) that is situated in one of said recesses with features (32) that engage the holes (h'); and the insulating overmold intimately engages the plurality of external arcuate recesses and the through holes.

7. The signal cable assembly of claim 3, wherein the signal pin (12) has a profiled exterior (18) immediately forward of the back pin (16); and the insulating overmold extends forward of the ground body (28) within the ground tube (26) to intimately engage the signal pin profile.

8. The signal cable assembly of claim 3, wherein a. the ground connector (30) has internal mounting features (32) that engage external mounting features (h') on the ground body;

b. the ground body has a profiled exterior (a, b) and the insulating overmold intimately engages the profiles; and c. the insulating overmold extends forward of the ground body within the ground tube (26).

9. The signal cable assembly of claim 8, wherein a. the ground body (28) has a plurality of external circular recesses (a, b) and having through holes (h, h') to the cable bore (56);

b. the ground connector (30) has an arcuate portion (34) that is situated in one of said plurality of external circular recesses with features that engage the through holes (h);

c. the insulating overmold intimately engages the recesses and passes through at least some of the holes into the cable bore (56), with intimate contact against the cable.

10. The signal cable assembly of claim 8, wherein the insulating overmold integrally extends rearward from the ground body as a tubular strain relief member around the coaxial cable and ground connector.

11. A method of assembling a signal cable assembly (10) comprising:

a. selecting a coaxial cable (40) having a central signal conductor, an insulator around the signal conductor, a conductive ground sheath around the insulator, and a covering;

b. forming a plug including (i) a conductive signal pin (12) having a forward signal tip (14) and a back pin (16) which define a plug axis; (ii) an insulating sleeve (20) concentrically around a portion of the conductive signal pin; (iii) a ground element (24) having a ground tube (26) concentrically around a portion of the insulating sleeve and a ground body (28) having an axial bore (56) for receiving the coaxial cable and at least one radial port (h); and (iv) a ground connector (30) supported on the ground body and extending rearward with tangs (38);

c. inserting a free end of the coaxial cable (40) into the axial bore of the ground body until the central signal conductor contacts the back pin (16) and the tangs overlay a portion of the covering of the coaxial cable; thereby forming an overlaid portion;

d. placing the ground body (28) with coaxial cable, the ground connector (30), and the overlaid portion of the coaxial cable in a mold;

e. closing the mold and delivering a pressurized flow of insulating material through the mold to the ground body (28) and covering portion of the coaxial cable including ground connector, whereby a first portion of said insulating material flows through said at least one port to fill the axial bore around said coaxial cable and to surround a portion of the signal pin (12) within the ground tube (26); and a second portion of said insulating material surrounds the ground body (28) and the ground connector (30) and pushes the tangs (38) through the covering (44) into conductive penetration of the ground sheath; and f. opening the mold and removing the signal cable assembly (10), having an over molded plug with the signal pin conductively engaging the central signal conductor and a ground conductor of the coaxial cable conductively engaging the ground sheath.

12. The method of claim 11, wherein upon completion of step f, the finished signal cable assembly comprises four operatively connected plug parts, wherein the plug parts include the conductive signal pin (12), the insulating sleeve (20), the ground element (24) and the ground connector (30); the signal conductor at one end (42) of the coaxial cable (40) conductively connected to a first of the plug parts being the conductive signal pin (12); and an overmold (54) encapsulating the end of the coaxial cable and a conductive connection between a cable ground sleeve and at least one second plug part different from the first plug part being selected from the group consisting of the sleeve (20), the ground element (24) and the ground connector (30), wherein a. the conductive signal pin (12) is conductive with the forward signal tip (14) and the back pin (16); the sleeve (20) is insulating and positioned around the signal pin between the forward signal tip and the back pin; the ground element (24) has the ground tube (26) around a portion of the insulating sleeve and the ground body (28) having the axial bore (56) for receiving the coaxial cable; and the ground connector (30) is supported on the ground body;

b. the coaxial cable (40) has a front end with central signal conductor (42) that engages the back pin (16) and a ground connector engages the ground conductor of the coaxial cable; and c. the overmold (54) is insulating and encapsulates the ground connector (30) and extends within the ground body (28), within the ground tube (26) and around the back pin (16).

13. The method of claim 11, wherein upon completion of step f, the finished signal cable comprises a. the conductive signal pin (12) extending along a longitudinal axis from the forward signal tip (14) to the back pin (16);

b. the insulating sleeve (20) around the conductive signal pin, abutting the forward signal tip and terminating forward of the back pin;

c. a conductive ground element (24) including the ground tube (26) and the ground body (28), wherein the ground tube passes over the insulting sleeve, with a front spaced from the forward signal tip to a back that extends rearward of the back pin, and the ground body is an externally profiled (a, b) hollow cylinder that extends rearward from the ground tube such that the bore (56) is formed through the ground element to the back pin;

d. the ground connector (30) supported on the ground body and having connector arms (36) that extend rearward with tangs (38) facing the longitudinal axis; (e) the coaxial cable (40) in said cable bore, having a front end (42) with central signal conductor engaging the back pin (16) and a portion of the cable (44) rearward of the ground body where the tangs of the connector engage the cable ground conductor; and (f) an overmold (54) encapsulating the ground connector and the ground body.

14. The method of claim 13, wherein a. the ground connector (30) has internal mounting features (32) that engage external mounting features (h') on the ground body;

b. the ground body has a profiled exterior (a, b) and the overmold intimately engages the profiles; and c. the overmold extends forward of the ground body within the ground tube (26).

15. The method of claim 14, wherein a. the ground body (28) has a plurality of external circular recesses (a, b) and having through holes (h, h') to the axial bore (56);

b. the ground connector (30) has an arcuate portion (34) that is situated in one of said recesses with features that engage the through holes (h);

c. the overmold intimately engages the recesses and passes through at least some of the through holes into the axial bore (56), with intimate contact against the coaxial cable.

16. The method of claim 14, wherein the overmold integrally extends rearward from the ground body as a tubular strain relief member around the axial cable and the ground connector.

17. A method of assembling a signal cable assembly (10) with plug parts including (i) a conductive signal pin (12) with front tip (14) and a back pin (16); (ii) an insulating sleeve (20) around the signal pin between the tip and the back pin; (iii) a ground element (24) having a ground tube (26) around a portion of the insulating sleeve and a ground body (28) having a bore for receiving a coaxial cable; and (iv) a ground connector (30) supported on the ground body, wherein the method comprises:

a. inserting a free end of the coaxial cable (40) into the bore of the ground body until a central signal conductor of the coaxial cable contacts the back pin (16);

b. placing the ground body (28) with the inserted free end of the coaxial cable, in a mold;

c. closing the mold and delivering a pressurized flow of insulating material through the mold through the ground body whereby a first portion of said insulating material flows into the bore around said coaxial cable and surrounds a portion of the conductive signal pin (12) within the ground tube (26); and a second portion of said insulating material surrounds the ground body (28); and d. opening the mold and removing the signal cable assembly (10), having an over molded plug with the conductive signal pin conductively engaging the central signal conductor and a ground conductor of the coaxial cable conductively engaging ground sheath.

* * * * *